US006641683B1

(12) United States Patent
McKenney, Jr. et al.

(10) Patent No.: US 6,641,683 B1
(45) Date of Patent: Nov. 4, 2003

(54) PLASTICIZED, WAX-BASED BINDER SYSTEM FOR MELT CASTABLE EXPLOSIVES

(75) Inventors: Robert L. McKenney, Jr., Niceville, FL (US); John F. Leahy, Fort Walton Beach, FL (US); Spencer T. Parkin, Shalimar, FL (US); Thomas R. Krawietz, Shalimar, FL (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 10/237,996

(22) Filed: Sep. 11, 2002

Related U.S. Application Data

(60) Provisional application No. 60/341,078, filed on Dec. 19, 2001.

(51) Int. Cl.[7] ..... C06B 45/06

(52) U.S. Cl. ..... 149/18; 149/44; 149/92

(58) Field of Search ..... 149/18, 44, 92

(56) References Cited

U.S. PATENT DOCUMENTS

| | | | | | |
|---|---|---|---|---|---|
| 4,747,892 | A | | 5/1988 | Spencer | |
| 4,889,571 | A | * | 12/1989 | Willer et al. | 149/19.9 |
| 5,210,153 | A | * | 5/1993 | Manser et al. | 149/19.6 |
| 5,529,649 | A | * | 6/1996 | Lund et al. | 149/19.1 |
| 5,717,158 | A | * | 2/1998 | Capellos et al. | 149/18 |
| 6,107,483 | A | * | 8/2000 | Wardle et al. | 540/546 |
| 6,425,966 | B1 | * | 7/2002 | Highsmith et al. | 149/19.1 |

* cited by examiner

*Primary Examiner*—Edward A. Miller
(74) *Attorney, Agent, or Firm*—Charles E. Bricker; Thomas L. Kundert

(57) ABSTRACT

A melt-castable explosive composition not based on TNT consisting essentially of about 10 to 20 weight percent of a matrix material having a melting temperature of about 80° to 100° C., about 1 to 5 weight percent of a plasticizer, up to about 20 weight percent of a metal powder, up to about 20 weight percent of an oxidizer and about 70 to 89 weight percent of a high explosive. The matrix material is carnauba wax modified with ozokerite wax in a weight ratio of about 1:1 to 20:1.

7 Claims, No Drawings

PLASTICIZED, WAX-BASED BINDER SYSTEM FOR MELT CASTABLE EXPLOSIVES

CROSS REFERENCE TO RELATED APPLICATION

This application claims priority of the filing date of Provisional Application Ser. No. 60/341,078, filed Dec. 19, 2001, the entire contents of which are incorporated by reference.

RIGHTS OF THE GOVERNMENT

The invention described herein may be manufactured and used by or for the Government of the United States for all governmental purposes without the payment of any royalty.

BACKGROUND OF THE INVENTION

The present invention relates to an improved castable high explosive, particularly to a castable explosive composition containing explosives which melt and/or decompose at temperatures higher than about 90° C.

Castable explosives are classified either as melt/cast or as plastic bonded. Melt/cast systems require the melting of the explosive, such as TNT (mp 81° C.), and casting into a munition. Plastic bonded systems involve a mixture of one or more explosives with a polymeric binder, casting into a munition, and curing of the binder.

Explosive compositions based on TNT constitute an important class of military explosives. Examples of such explosive compositions include Composition B (RDX-cyclotrimethylenetrinitramine and TNT-2,4,6-trinitrotoluene), Tritonal (TNT and aluminum powder), cyclotols (RDX and TNT in ratios of 75:25 to 60:40), Amatol (ammonium nitrate and TNT), Kalatol (potassium nitrate and TNT), Baratol (barium nitrate and TNT, Pentolite (PETN-pentaerythritol tetranitrate and TNT) and Baronal (barium nitrate, aluminum and TNT). Such compositions are generally prepared by stirring the solid powdered components, which include such materials as RDX, HMX (cyclotetramethylenetetranitramine), PETN, NQ (nitroguanidine), ammonium nitrate, potassium nitrate, barium nitrate, lead nitrate, potassium perchlorate, ammonium perchlorate, aluminum powder, and the like, as well as mixtures thereof, which are essentially insoluble in TNT, with molten TNT until a homogeneous dispersion or slurry is obtained. The molten slurry is loaded into shells or other ordnance items by pouring into the cavity and allowing the melt to cool and solidify. Such slurries, which in concentrated cases are very viscous and difficult to pour, exhibit undesirable segregation and settling of the solids during the period required for cooling and solidification, thereby producing casts of non-uniform composition, which adversely affects the explosive and ballistic characteristics of the item. In the past, small amounts of additives, such as finely divided silica, silicone resins, nitrocellulose and other cellulosic resins, have been added to improve the suspension of the solid components in the TNT slurry.

TNT-based explosive compositions have a tendency to exude low melting impurities such as dinitrotoluene and mononitrotoluene, as well as unsymmetrical isomers of trinitrotoluene. It is known that high molecular weight nitrocellulose has the propensity to accept these low melting impurities of the composition. As a result of substantially high uptake in this regard, relatively small amounts of the nitrocellulose are necessary to prevent exudation of the cast.

Thus, the viscosity of the melt is not appreciably altered by the addition of such cellulosic additive and the pourability of the composition is maintained. It has also been found that by such addition of cellulosic material, an explosive cast is obtained having greater mechanical strength and enhanced heat resistance.

In addition to exudation, TNT-based explosive compositions tend to crack upon temperature cycling, decompose autocatalytically upon exposure to fire and explode or detonate when in a bomb or warhead configuration, and further tend to detonate on sudden impact. These drawbacks have been partially corrected in the past by using wax type coatings as desensitizers and process aids. Beeswax was used initially at a level of about 1 wt. percent to desensitize Composition B. Shortages of beeswax led to a search for substitutes which concentrated on paraffin wax, microcrystalline waxes and synthetic waxes. Such wax coatings are deposited irregularly as agglomerates onto the explosive composition. As such, wax coatings tend to separate from the explosive composition surface upon exposure to heat and create potential cook-off conditions.

The waxes employed heretofore are generally not soluble in TNT. In order to form an emulsion of the explosive and wax, emulsifying aids are often added, as for example, lecithin as an emulsifier. Dispersions of 5% or greater of paraffin wax in TNT-based explosives are not truly stable emulsions As noted previously, plastic bonded systems involve a mixture of one or more explosives with a polymeric binder. Binders used heretofore include polyester, polyurethane polystyrene, fluorinated polymers and various synthetic rubbers. Plastic bonded systems require thorough mixing of the ingredients with special emphasis on the quantity and mixing of the curing agent or catalyst. Once cast into a munition, a cure time of several days, at an elevated temperature, is required to ensure complete cure of the binder Plastic bonded systems have an advantage over conventional melt/cast systems in that virtually any explosive can be cast into a munition. In particular, explosives can be cast into munitions independent of the melt temperature of the explosive (s), while conventional melt/cast systems depend on at least one explosive ingredient being meltable at a safe processing temperature. The phrase "safe processing temperature" generally means about 121° C. or lower which corresponds to the temperature of steam at 15 psig Melt/cast systems have an advantage over plastic bonded systems of higher processing and loading capacity. The melt/mix time is relatively much shorter, process control is not as critical, and no curing time is required. Melt/cast systems have a further advantage if unloading of the munition is ever required in that the cast explosive can be melted using a low pressure steam.

Military munition items based on TNT are currently fielded, but due to the environmental impact of producing TNT, new production of TNT is either slowed or suspended. Spencer, U. S. Pat. No. 4,747,892, issued May 31, 1988, discloses a melt-castable explosive composition not based on TNT consisting essentially of about 10 to 20 weight percent of a matrix material having a melting temperature of about 60° to 100° C., up to about 0.5 weight percent of an emulsifying agent and up to about 20 weight percent aluminum powder, balance high explosive. The matrix material is ozokerite wax, ozokerite modified with 5 to 25 weight percent carnauba wax, or a waxy polyethylene.

Due to thermal cycling and transportation testing requirements of explosive formulations, high Ozokerite wax formulations (Ozokerite wax blends with up to 25% Carnauba wax) and polyethylene wax PW500 will not pass these tests (Growth and Exudation per "MIL STD-1751", and Test Series 3(c) per United Nations' "Recommendations on the Transport of Dangerous Goods" -ISBN 92-1-139049-4). Formulations employing a binder system of polyethylene wax such as PW600, and mixtures of PW600 and PW500, have broad melting ranges and require processing temperatures at temperatures approximately 15° C. higher than TNT based materials. The high processing/casting temperatures required with PW600 and PW600/PW500 mixtures can lead to explosive safety issues due to the thermal decomposition of the contained explosive materials and possible thermal runaway.

What is desired is an explosive composition which has the advantages of both the melt/cast and plastic bonded systems. The desired composition allows melt/cast processing without dependence on the melt temperature of the explosive ingredients.

Accordingly, it is an object of the present invention to provide a melt-castable explosive not based on TNT for use in munition items that are capable of safely utilizing existing equipment and techniques currently employed with the processing and casting of TNT based explosive formulations.

Other objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

SUMMARY OF THE INVENTION

In accordance with the present invention there is provided a melt-castable explosive composition not based on TNT consisting essentially of about 10 to 20 weight percent of a matrix material having a melting temperature of about 800 to 100° C., about 1 to 5 weight percent of a plasticizer, up to about 20 weight percent of a metal powder, up to about 20 weight percent of an oxidizer and about 70 to 89 weight percent of a high explosive. The matrix material is carnauba wax modified with ozokerite wax in a weight ratio of about 1:1 to 20:1.

The plasticizer can be bis(2-ethyl-hexyl)adipate, isodecyl pelargonate, bis(2-ethyl-hexyl)sebacate, dioctyladipate, isodecylperlargonate, dioctylphthalate, dioctylmaleate, dibutylphthalate, oleyl nitrile, or mixtures thereof.

Reactive metals may optionally be added to the explosive compositions of the present invention to achieve high heats of reaction. The reactive metal is preferably aluminum or magnesium, although other reactive metals may also be used such as boron, titanium, zirconium, silicon, or mixtures thereof. Selected metal alloys may also be used, such as aluminum/magnesium and aluminum/lithium alloys. These types of alloys have been used successfully in the solid rocket propellant industry. Such alloys react more completely than pure metals by virtue of the increased reactivity and lower ignition and cutoff temperatures. Increased metal reactivity further improves overall combustion efficiency which translates into the generation of greater amounts of heat during the reaction of the explosive. The reactive metal content of the explosive compositions within the scope of the present invention typically ranges from 0 wt. % to 20 wt. %, more preferably from 5 wt. % to 10 wt. %.

An oxidizer may optionally be included in the explosive compositions according to the present invention to assist in metal combustion. Typical oxidizers are preferably selected from AP (ammonium perchlorate) or AN (ammonium nitrate), although other oxidizers can be used such as HAN (hydroxylammonium nitrate), AND (ammonium dinitramide), lithium perchlorate, potassium perchlorate, lithium nitrate, or mixtures thereof. Useful oxidizers are characterized by high density and oxygen content. The oxidizer will typically be present in a concentration from 0 wt. % to 20 wt. % of the total explosive composition.

Typical high explosives which can be used in the present invention include known and novel nitramines and other high explosives such as CL-14 (5,7-diamino-4,6-dinitrobenzofuroxan), CL-20 (2,4,6,8,10,12-hexanitro-2,4,6,8,10,12-hexaazatetracyclo(5.5.0.0$^{5,9}$. 0$^{3,11}$)-dodecane), RDX (1,3,5-trinitro-1,3,5-triazacyclohexane), HMX (1,3,5,7-tetra-nitro-1,3,5,7-tetraazacyclooctane), TEX (4,10-dinitro-2,6,8,12-tetraoxa-4,10-diazatetracyclo(5.5.0. 0$^{5,9}$. 0$^{3,11}$)dodecane), NTO (3-nitro-1,2,4-triazol-5-one), NQ (nitroguanidine), TAG nitrate (triaminoguanidinium trinitrate), PETN (pentaerythritol tetranitrate), TATB (1,3,5-triamino-2,4,6-trinitrobenzene), TNAZ (1,3,3-trinitroazetidine), AND (ammonium dinitramide), DADNE (1,1-diamino-2,2-dinitro ethane), DADE (2,2-diamino-dinitroethylene), and mixtures thereof. Those skilled in the art will appreciate that other known and novel high explosives not listed above may also be used in the present invention. The high explosive will typically be present in a concentration from 70 wt. % to 89 wt. % and preferably from 60 wt. % to 70 wt. % of the total explosive composition.

Other additives which may be employed include barium nitrate, sodium nitrate, potassium nitrate, nitrocellulose, carbon fiber, and tungsten.

The explosive compositions are prepared according to the following general procedure. First, the plasticizer is added to a mix bowl and warmed. The wax components are then added to the bowl and allowed to melt. Fine high explosive powder is slowly added to melted wax/plasticizer mixture and mixed. Coarse high explosive powder is slowly added to melted wax/plasticizer/explosive mixture and mixed. The temperature, during these additions, should not drop below about 80° C. nor exceed 95° C. The melt-kettle is sealed and evacuated for 15 minutes while under constant mixing at 60 rpm. The temperature of kettle is adjusted between 820° and 84° C. while under vacuum. The mixer blade is stopped, the kettle is returned to ambient pressure, and the explosive composition is cast into suitable fixtures or molds which may or not be heated to between 60° and 70° C. The cast fixtures are placed in oven at 70° C. and allowed to cool to room temperature using a controlled cool-down over 10 hours.

The explosive composition of this invention can be used in military munition development and production (e.g. bombs, warheads, artillery shells, and mines) where TNT based materials (e.g. TNT, Composition B, Octol, and Pentolite) are currently used. Explosive formulations using the plasticized, wax binder system melt at temperatures between 750° and 82° C., essentially equivalent to TNT-based formulations, and can be prepared and cast using equipment designed for TNT melt-cast operations. Due to the need for less than 20 weight percent binder in explosive formulations employing the plasticized, wax based binder system, shrinking/piping problems associated with solidification are significantly less than those of TNT-based formulations.

The plasticizer, wax binder system detailed in this invention has been used in an explosive formulation and passed all required tests (for explosive sensitivity, mechanical, and thermal properties). Since the melt-castable binder matrix is devoid of TNT, the plasticized, wax binder can be used with chemicals that are incompatible with TNT such as ammonium perchlorate, allowing formulation of oxygen balanced explosives (which will increase explosive performance). The binder matrix is devoid of surfactants such as Ganex or Lecithin, which outgas during processing explosive batches and lead to low charge densities. Additionally, the relatively low content of binder matrix required relative to TNT formulations, causes less shrinkage upon solidification and therefore less explosive riser volume is needed.

The following examples illustrate the invention:

EXAMPLE 1

The following composition was prepared, generally following the procedure given above:

| Component | Weight percent |
|---|---|
| Carnauba SP8 | 10.87 |
| Ozokerite 1410 | 3.63 |
| bis(2-ethyl-hexyl)adipate | 2.50 |
| explosive nitramine mixture | 83.00 |

Detonation performance parameters:

Detonation Velocity (unconfined 2" diameter charge): 8.105 km/sec

Detonation Pressure (unconfined 2" diameter charge): 230 kBar

NOL Shock Sensitivity: 45.4 kBar

Gurney Constant (sqrt(3E)): 2.65 km/sec

EXAMPLE 2

The following composition was prepared, generally following the procedure given above:

| Component | Weight percent |
|---|---|
| Carnauba SP8 | 7.25 |
| Ozokerite 1410 | 7.25 |
| bis(2-ethyl-hexyl)adipate | 2.50 |
| explosive nitramine mixture | 83.00 |

Detonation performance parameters:

Detonation Velocity (unconfined 2" diameter charge): 7.73 km/sec

Detonation Pressure (unconfined 2" diameter charge): 193 kBar

EXAMPLE 3

The following composition was prepared, generally following the procedure given above:

| Component | Weight percent |
|---|---|
| Carnauba SP8 | 11.40 |
| Ozokerite 1410 | 0.60 |
| bis(2-ethyl-hexyl)adipate | 5.00 |
| explosive nitramine mixture | 65.00 |
| metal fuel | 18.00 |

Detonation performance parameters:

Detonation Velocity (unconfined 2" diameter charge): 7.75 km/sec

Detonation Pressure (unconfined 2" diameter charge): 181 kBar

EXAMPLE 4

The following composition was prepared, generally following the procedure given above:

| Component | Weight percent |
|---|---|
| Carnauba SP8 | 10.06 |
| Ozokerite 1410 | 0.53 |
| bis(2-ethyl-hexyl)adipate | 4.41 |
| explosive nitramine mixture | 39.00 |
| metal fuel | 22.00 |
| inorganic oxidizer | 24.00 |

Detonation performance parameters:

Detonation Velocity (unconfined 2" diameter charge): 6.78 km/sec

Detonation Pressure (unconfined 2" diameter charge): 127 kBar

EXAMPLE 5

The following composition was prepared, generally following the procedure given above:

| Component | Weight percent |
|---|---|
| Carnauba SP8 | 6.15 |
| Ozokerite 1410 | 6.15 |
| bis(2-ethyl-hexyl)adipate | 2.50 |
| explosive nitramine mixture | 82.00 |
| surfactant (Ganex) | 0.20 |
| graphite powder | 3.00 |

EXAMPLE 6

The following composition was prepared, generally following the procedure given above:

| Component | Weight percent |
|---|---|
| Carnauba SP8 | 6.25 |
| Ozokerite 1410 | 6.25 |
| bis(2-ethyl-hexyl)adipate | 2.50 |
| explosive nitramine mixture | 83.00 |
| metal fuel | 2.00 |

EXAMPLE 7

The following composition was prepared, generally following the procedure given above:

| Component | Weight percent |
|---|---|
| Carnauba SP8 | 9.50 |
| Ozokerite 1410 | 3.00 |
| bis(2-ethyl-hexyl)adipate | 2.50 |
| explosive nitramine mixture | 83.00 |
| metal fuel | 2.00 |

Having thus described exemplary embodiments of the present invention, it should be noted by those skilled in the art that the disclosures herein are exemplary only and that alternatives, adaptations and modifications may be made within the scope of the present invention.

We claim:

1. A melt-castable explosive composition consisting essentially of about 10 to 20 weight percent of a matrix material having a melting temperature of about 80° to 100° C., about 1 to 5 weight percent of a plasticizer, up to about 20 weight percent of a metal powder, up to about 20 weight percent of an oxidizer and about 70 to 89 weight percent of a high explosive wherein said matrix material is carnauba wax modified with ozokerite wax in a weight ratio of about 1:1 to 20:1.

2. The composition of claim 1 wherein said plasticizer is selected from the group consisting of bis(2-ethyl-hexyl) adipate, isodecyl pelargonate, bis(2-ethyl-hexyl)sebacate, dioctyladipate, isodecylperlargonate, dioctylphthalate, dioctylmaleate, dibutylphthalate, oleyl nitrile, and mixtures thereof.

3. The composition of claim 1 wherein said metal powder is selected from the group consisting of aluminum, magnesium, boron, titanium, zirconium, silicon, aluminum/magnesium alloy, aluminum/lithium alloy, and mixtures thereof.

4. The composition of claim 3 wherein said metal powder is aluminum.

5. The composition of claim 3 wherein said metal powder is magnesium.

6. The composition of claim 1 wherein said oxidizer is selected from the group consisting of ammonium perchlorate, ammonium nitrate, hydroxylammonium nitrate, ammonium dinitramide, lithium perchlorate, potassium perchlorate, lithium nitrate, and mixtures thereof.

7. The composition of claim 1 wherein said high explosive is selected from group consisting of CL-14, CL-20, RDX, HMX, TEX, NTO, NQ, TAG nitrate, PETN, TATB, TNAZ, AND, DADNE, DADE, and mixtures thereof.

* * * * *